US007772778B2

(12) United States Patent
Satoh et al.

(10) Patent No.: US 7,772,778 B2
(45) Date of Patent: Aug. 10, 2010

(54) METHOD FOR FORMING ELECTRODES AND/OR BLACK STRIPES FOR PLASMA DISPLAY SUBSTRATE

(75) Inventors: Ryohei Satoh, Minoh (JP); Yoshinori Iwata, Osaka (JP); Koji Nakagawa, Osaka (JP); Kenji Tanaka, Tokyo (JP); Satoru Takaki, Yokohama (JP)

(73) Assignee: Asahi Glass Company, Limited, Tokyo (JP)

( * ) Notice: Subject to any disclaimer, the term of this patent is extended or adjusted under 35 U.S.C. 154(b) by 348 days.

(21) Appl. No.: 11/691,689

(22) Filed: Mar. 27, 2007

(65) Prior Publication Data

US 2007/0190886 A1 Aug. 16, 2007

Related U.S. Application Data

(63) Continuation of application No. PCT/JP2005/015683, filed on Aug. 29, 2005.

(30) Foreign Application Priority Data

Sep. 27, 2004 (JP) ..... 2004-279497

(51) Int. Cl.
*H01J 17/49* (2006.01)

(52) U.S. Cl. ..... 313/587; 313/586; 445/24

(58) Field of Classification Search ..... 313/582–587; 445/24

See application file for complete search history.

(56) References Cited

U.S. PATENT DOCUMENTS 6,342,276 B1 1/2002 You
6,805,601 B2 10/2004 Aoki et al.

(Continued)

FOREIGN PATENT DOCUMENTS

JP 3-147227 A 6/1991

(Continued)

OTHER PUBLICATIONS

"Flat Panel Display Dictionary", edited by Tatsuo Uchida and Hiraki Uchiike, published by Kogyochosakai, Dec. 25, 2001, p. 583-585.

(Continued)

*Primary Examiner*—Bumsuk Won
(74) *Attorney, Agent, or Firm*—Oblon, Spivak, McClelland, Maier & Neustadt, L.L.P.

(57) ABSTRACT

To provide a method for forming electrodes and/or black stripes for a plasma display substrate, wherein display electrodes, bus electrodes and optionally black stripes for a plasma display panel are formed of the same material by the same dry step, whereby a clear image having reflection prevented, can be displayed on a PDP display device with a low load on the environment, at low costs, with low resistance, without erosion by a dielectric.

A method for forming electrodes and/or black stripes for a plasma display substrate, which comprises applying a laser beam to a mask layer formed on a transparent substrate to form openings at areas corresponding to the respective patterns of display electrodes, bus electrodes and optionally black stripes, then continuously forming an antireflection layer to provide an antireflection effect over the entire surface and an electrode layer, and applying again a laser beam to peel off the mask layer and at the same time to remove an unnecessary thin film layer.

20 Claims, 10 Drawing Sheets

U.S. PATENT DOCUMENTS

| | | | | |
|---|---|---|---|---|
| 2001/0004065 | A1* | 6/2001 | Oh et al. | 216/10 |
| 2004/0239246 | A1 | 12/2004 | Asida et al. | |
| 2004/0259452 | A1* | 12/2004 | Matsumoto et al. | 445/24 |
| 2006/0240338 | A1 | 10/2006 | Satoh et al. | |

FOREIGN PATENT DOCUMENTS

| | | | |
|---|---|---|---|
| JP | 4-345734 | A | 12/1992 |
| JP | 7-65727 | | 3/1995 |
| JP | 9-92139 | A | 4/1997 |
| JP | 9-283029 | A | 10/1997 |
| JP | 11-312464 | A | 11/1999 |
| JP | 11-339672 | A | 12/1999 |
| JP | 2001-176380 | A | 6/2001 |
| JP | 2001-236885 | A | 8/2001 |
| JP | 2002-160079 | A | 6/2002 |
| JP | 2003-68216 | A | 3/2003 |
| JP | 2003-215816 | A | 7/2003 |

OTHER PUBLICATIONS

"Flat Panel Display 2004 Practical Volume", edited by Kenji Okumura, published by Nikkei BP, p. 176-183.

U.S. Appl. No. 12/364,314, filed Feb. 2, 2009, Satoh, et al.

* cited by examiner

METHOD FOR FORMING ELECTRODES AND/OR BLACK STRIPES FOR PLASMA DISPLAY SUBSTRATE

TECHNICAL FIELD

The present invention relates to a method for forming electrodes and/or black stripes for a plasma display substrate; a plasma display substrate provided with electrodes and/or black stripes, thereby formed; and a plasma display panel employing it.

BACKGROUND ART

A plasma display panel (hereinafter referred to also as "PDP") can be made thin and easily large-sized and further has characteristics such as light weight, high resolution, etc., and thus, it has attracted attention as a prospective candidate to be substituted for CRT as a display device.

PDP is generally classified into a DC type and an AC type, but its operational principle is one utilizing a light emission phenomenon due to gas discharge. For example, in the AC type, as shown in FIG. 11, cells (spaces) are defined by partition walls 3 formed between a transparent front substrate 1 and a rear substrate 2 facing each other, and in the cells, a Penning mixed gas such as He+Xe or Ne+Xe having a high ultraviolet light emission efficiency with little visual light emission, is sealed. And, in the cells, plasma discharge is induced to let phosphor layers 11 on the inner walls of the cells emit light thereby to form an image on a display screen.

In such a PDP display device, as electrodes to induce plasma discharge in pixels for forming an image, display electrodes 5 made of transparent conductive films and bus electrodes 6 on part of such display electrodes are formed by patterning on a transparent front substrate 1, and if necessary, black stripes 4 to separate pixels are formed by patterning. Further, on a rear substrate 2, address electrodes 7 are formed by patterning. And, in order to secure insulation between the display electrodes 5 and the address electrodes 7 to let plasma be generated constantly or to prevent the electrodes from erosion by plasma, the display electrodes 5, the bus electrodes 6 and the black stripes 4 are covered by a dielectric layer 8 and a MgO protective layer 9 (Patent Document 1 and Non-Patent Documents 1 and 2).

PDP of the DC type is different from the AC type in that the display electrodes are not covered by a dielectric layer and a protective layer.

Here, the above display electrodes 5 are desired to have a low resistance. Therefore, heretofore, it has been common to employ indium oxide containing tin oxide (hereinafter referred to also as "ITO"). ITO is commonly used, since it has a relatively low electric resistance and is excellent in transparency, electrical conductivity and patterning performance.

However, ITO is expensive. Further, in PDP of the AC type, if ITO is covered with a dielectric, the dielectric is likely to erode ITO, and the resistivity of ITO is likely to be thereby increased.

In order to improve the durability of ITO against such erosion by the dielectric, it is possible to adjust the components of the dielectric. However, in such a case, the original purposes of the dielectric, such as the insulation performance and the performance to prevent erosion from plasma, are likely to decrease at the same time. Therefore, a material to be substituted for such ITO and the corresponding method are strongly desired.

On the other hand, the respective patterns of the display electrodes 5, the bus electrodes 6 and the black stripes 4 as shown in FIG. 11, are usually sequentially separately formed by patterning by a photolithography/etching process. Accordingly, the production process is long and expensive, and a strong acid or a strong alkaline solution is employed, whereby the load to the environment is large. Therefore, a method which can be substituted for such a process is desired.

Further, it has been proposed to provide black stripes 4 to further improve the contrast thereby to make an image clearer, but they will be formed by a step separate from the steps for forming display electrodes 5, bus electrodes 6, etc., and thus the number of steps will correspondingly be increased.

Patent Document 1: JP-A-7-65727

Non-Patent Document 1: "Flat Panel Display Dictionary", edited by Tatsuo Uchida and Hiraki Uchiike, published by Kogyochosakai, Dec. 25, 2001, p. 583-585

Non-Patent Document 2: "Flat Panel Display 2004 Practical Volume", edited by Kenji Okumura, published by Nikkei BP, p. 176-183

DISCLOSURE OF THE INVENTION

Objects to be Accomplished by the Invention

An object to be accomplished by the present invention is to provide a method for forming electrodes and/or black stripes for a plasma display substrate, wherein display electrodes employing ITO, bus electrodes employing Ag or Cr/Cu/Cr and optionally black stripes employing a black color dielectric, for a plasma display panel, are formed of the same material by the same dry step, whereby a clear image having reflection prevented, can be displayed on a PDP display device with a low load on the environment, at low costs, with low resistance, without erosion by a dielectric. Further, another object is to provide a plasma display substrate provided with electrodes and/or black stripes formed by such a method. Still another object is to provide PDP employing such a plasma display substrate.

Means to Accomplish the Objects

In order to accomplish the above objects, the present invention provides the following method for forming electrodes and/or black stripes for a plasma display substrate; a plasma display substrate provided with electrodes and/or black stripes formed by such a method; and PDP employing such a plasma display substrate.

In order to accomplish the above objects, the present invention provides a method for forming electrodes and/or black stripes for a plasma display substrate, which comprises forming a mask layer on a transparent substrate (a mask layer-forming step), applying a first laser beam to the mask layer to form openings at areas corresponding to the respective patterns of display electrodes, bus electrodes and optionally black stripes (an opening-forming step), then continuously forming an antireflection layer to provide an antireflection effect over the entire surface and an electrode layer (an antireflection layer-forming step and an electrode forming step), and applying again a laser beam to peel off the mask layer and at the same time to remove an unnecessary layer (a removing step).

In such a method for forming electrodes and/or black stripes for a plasma display substrate, in the removing step, it is preferred to apply a second laser beam to peel off the mask layer from the transparent substrate.

Further, the above antireflection layer preferably comprises a first antireflection layer made of chromium oxide and/or titanium oxide and a second antireflection layer made of Cr and/or Ti.

Further, the above mask layer is preferably made of an organic material.

Further, the above mask layer is preferably made of a material containing from 10 to 99 mass % of a black pigment or black dye.

Further, the first laser beam or the second laser beam is preferably a laser beam having a wavelength of from 500 to 1,500 nm and an energy density of from 0.1 to 5 J/cm$^2$.

Further, the mask layer preferably has an absorption coefficient with respect to the second laser beam, which is at least twice the absorption coefficient of the antireflection layer with respect to the second laser beam.

Further, the mask layer has an absorption coefficient of at least 70% with respect to the first laser beam.

Further, the openings have an overhang shape or an inversely tapered shape.

Further, the electrode layer is preferably made of copper, silver, aluminum or gold, and Cr and/or Ti is incorporated in the electrode layer.

Further, it is preferred to provide a Cr and/or Ti layer-forming step for forming a layer comprising Cr and/or Ti, after the electrode layer-forming step.

Further, it is preferred to provide a step for forming a thin film layer and removing a part of the thin film layer by applying a third laser beam to the thin film layer, before the mask layer-forming step or after the removing step.

Further, the present invention provides a plasma display substrate provided with electrodes and/or black stripes, formed by the above method for forming electrodes and/or black stripes, or a plasma display device having a first antireflection layer made of chromium oxide and/or titanium oxide, a second antireflection layer made of Cr and/or Ti, and an electrode layer made of Cu, formed on a transparent substrate in this order.

Further, in the present invention, the above plasma display device is preferably a front substrate of plasma display, and the electrodes and/or black stripes preferably have a visible light reflectance of at most 50% from the substrate side. Here, the visual light transmittance is one prescribed in JIS R3106 (1998), and "the substrate side" is the side of the transparent substrate on which no mask layer is formed.

Further, the present invention provides a plasma display panel employing the above plasma display substrate.

EFFECTS OF THE INVENTION

According to the present invention, display electrodes made of ITO, bus electrodes employing Ag or Cr/Cu/Cr and optional black stripes employing a black dielectric, for a plasma display substrate, which used to be produced by using different materials respectively, can be formed of the same material which is inexpensive, has a low resistance and is less susceptible to erosion by a dielectric, and further, it is possible to provide a method for forming electrodes and/or black stripes for a plasma display substrate, capable of displaying a clear image on a PDP display device.

Further, according to the present invention, as compared with a conventional wet system such as a photolithography/etching process or a wet lift-off method, it is possible to form electrodes and/or black stripes for a plasma display substrate in a smaller number of process steps at lower costs. Further, it is a dry method employing a laser beam, whereby it is unnecessary to use a large amount of a chemical liquid such as a developer or an etching agent as in the wet method, and it is unnecessary to worry so much about a load on the environment such as waste liquid treatment which has becomes a serious concern recently.

MEANINGS OF REFERENCE SYMBOLS

Figure 1A:
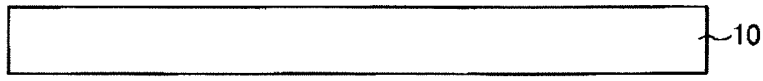
FIGS. 1(*a*) to (*d*) are schematic cross-sectional views of a plasma display substrate showing the process steps of a preferred embodiment of the method for forming electrodes and/or black stripes for a plasma display device of the present invention.
Figure 1B:
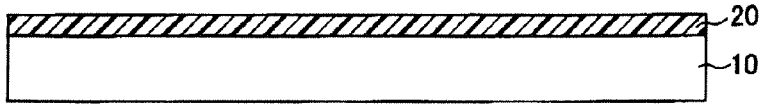
Figure 1C:
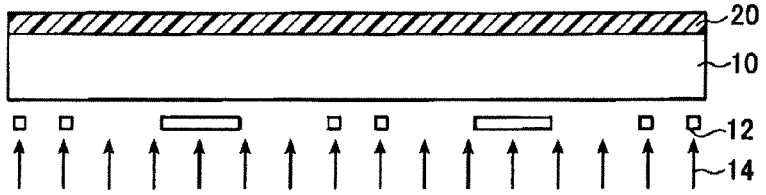
Figure 1D:
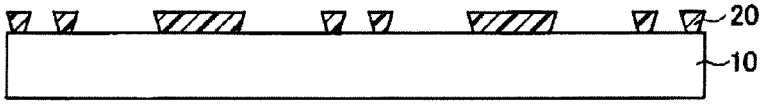
Figure 2E:
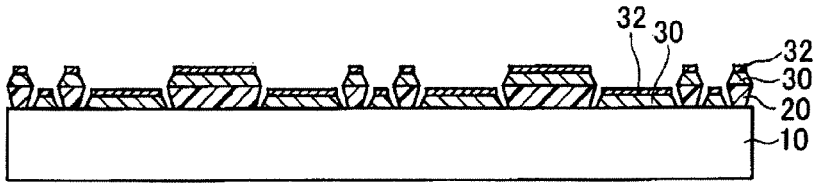
FIGS. 2(*e*) to (*h*) are schematic cross-sectional views of a plasma display substrate showing the process steps of a preferred embodiment of the method for forming electrodes and/or black stripes for a plasma display device of the present invention.
Figure 2F:
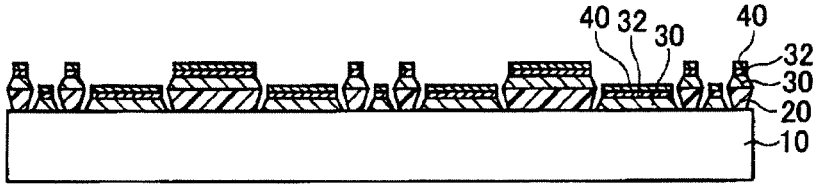
Figure 2G:
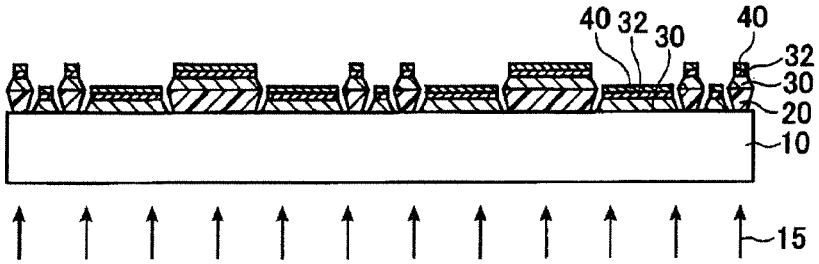
Figure 2H:
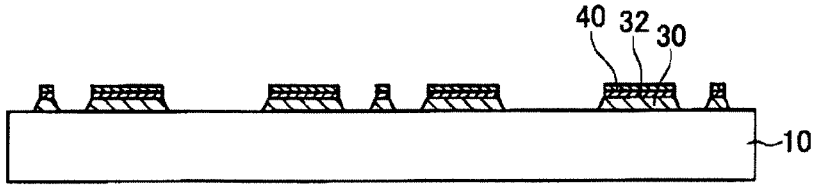
Figure 3A:
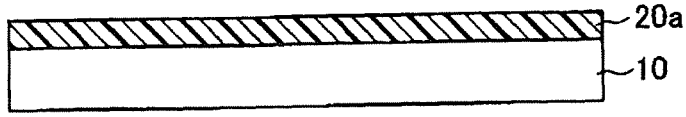
FIGS. 3(*a*) to (*g*) are schematic cross-sectional views of a plasma display substrate showing the opening-forming step in the method for forming electrodes and/or black stripes for a plasma display device of the present invention.
Figure 3B:
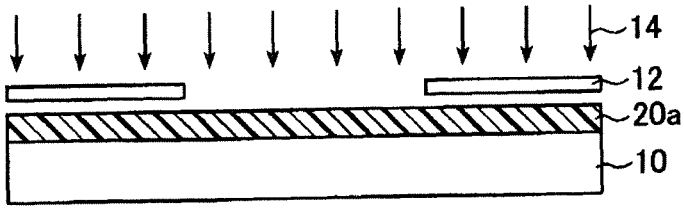
Figure 3C:
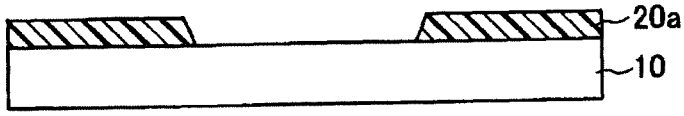
Figure 3D:
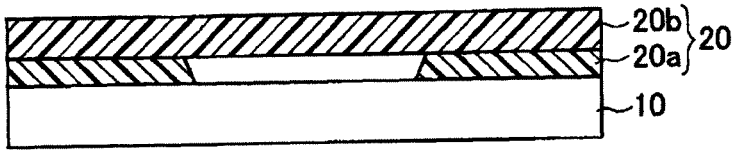
Figure 3E:
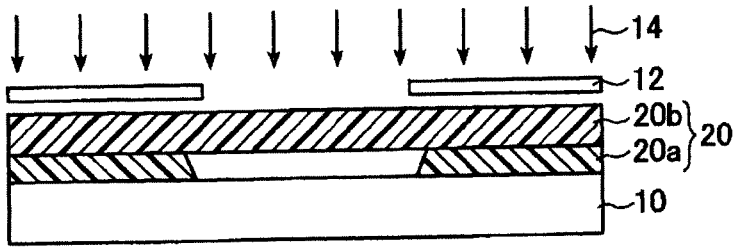
Figure 3F:
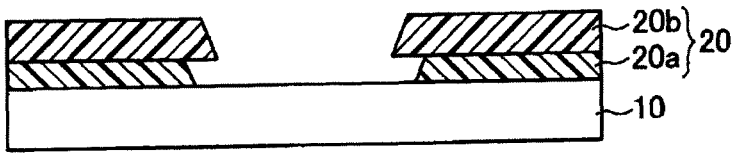
Figure 3G:
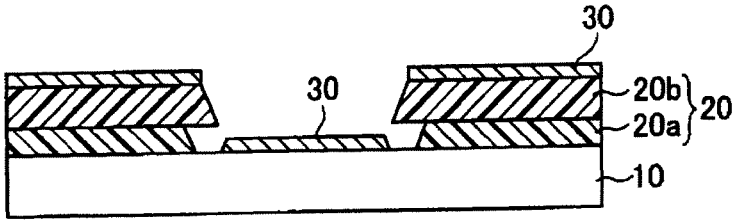
Figure 4A:
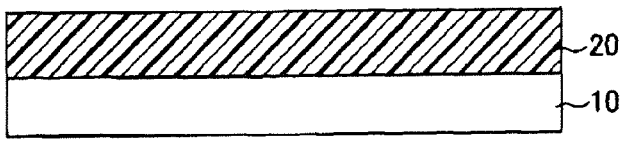
FIGS. 4(*a*) to (*f*) is a schematic cross-sectional view of a plasma display substrate showing the opening-forming step in the method for forming electrodes and/or black stripes for a plasma display device of the present invention.
Figure 4B:
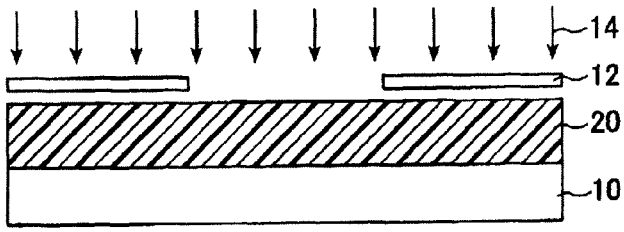
Figure 4C:
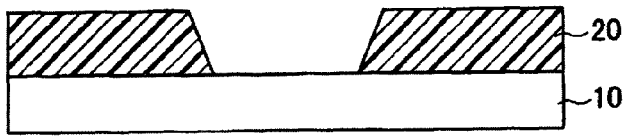
Figure 4D:
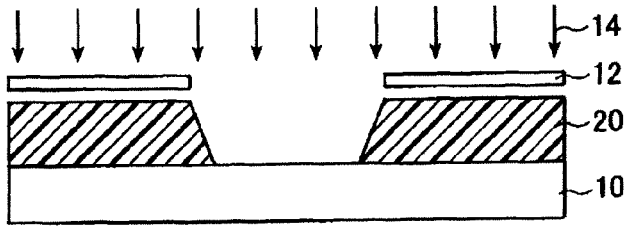
Figure 4E:
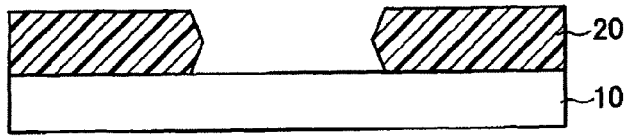
Figure 4F:
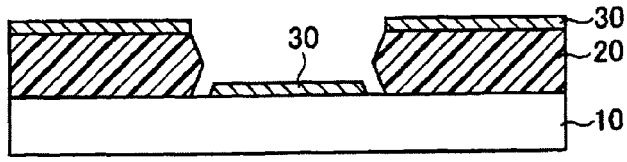
Figure 5A:
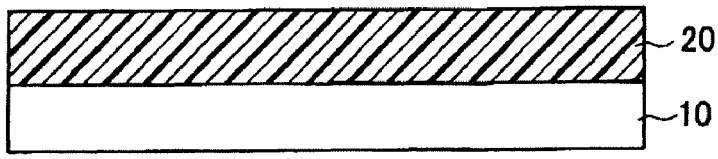
FIGS. 5(*a*) to (*d*) are schematic cross-sectional views of a plasma display substrate showing the opening-forming step in the method for forming electrodes and/or black stripes for a plasma display substrate of the present invention.
Figure 5B:
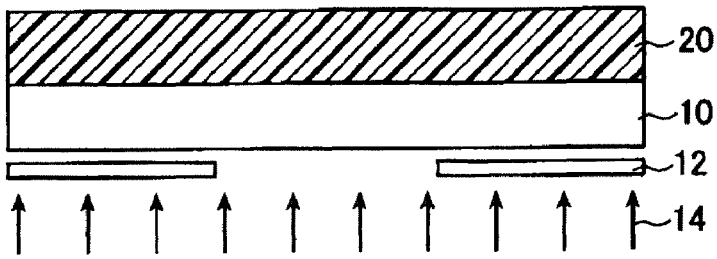
Figure 5C:
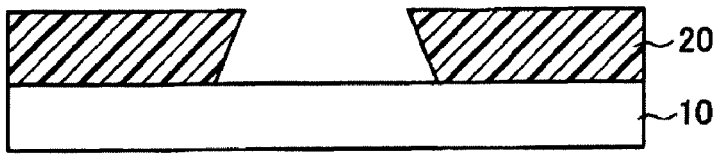
Figure 5D:
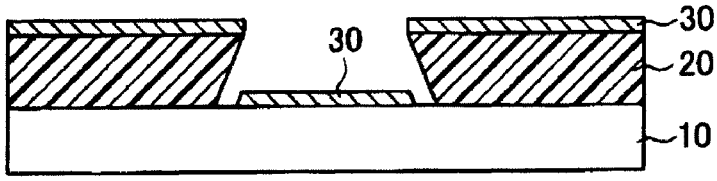

1: front substrate
2: rear substrate
3: partition wall
4: black stripe
5: display electrode
6: bus electrode
7: address electrode
8: dielectric layer

9: MgO protective layer
11: phosphor layer
10: transparent substrate
12: photomask
14: first laser beam
15: second laser beam
20, 20*a* and 20*b*: mask layers
30: first antireflection layer
32: second antireflection layer
40: electrode layer
60: transparent substrate
61: black stripe
62: electrode for a plasma display substrate
63: first antireflection layer
64: second antireflection layer
66: electrode layer
68: protective layer
70: glass substrate
72: mask film
74: film laminator
78: photomask
80: sputtering device
82: first antireflection layer
84: second antireflection layer
86: electrode layer
88: protective layer

BEST MODE FOR CARRYING OUT THE INVENTION

A preferred embodiment of the method for forming electrodes and/or black stripes for a plasma display substrate of the present invention will be described in detail with reference to FIGS. 1 and 2. This preferred embodiment is merely an example, and the present invention is by no means restricted thereto.

In the preferred embodiment of the method for forming electrodes and/or black stripes for a plasma display substrate of the present invention, firstly, a mask layer 20 is formed on a transparent substrate 10 (FIGS. 1(*a*) and (*b*), mask layer-forming step). Hereinafter, the surface of the transparent substrate 10 on which the mask layer 20 is formed will be referred to as "the upper surface", and the opposite surface will be referred to as "the lower surface".

Then, via a photomask 12, a first laser beam 14 is applied from the lower surface side to the mask layer 20 to form openings (FIGS. 1(*c*) and (*d*), opening-forming step).

And, on the upper surface of the transparent substrate 10 and on the upper surface of the mask layer 20, an antireflection layer i.e. a first antireflection layer 30 and a second antireflection layer 32 are formed (FIG. 2(*e*), antireflection layer-forming step); on the upper surface side of the second antireflection layer 32, an electrode layer 40 is formed (FIG. 2(*f*), electrode layer-forming step); and a second laser beam 15 is applied from the lower surface side to the mask layer 20 to remove the mask layer 20 from the transparent substrate 10 (FIGS. 2(*g*) and (*h*), removing step).

By such a process, it is possible to form the antireflection layer 30 on the upper surface on the transparent substrate 10, the antireflection layer 32 on the upper surface thereof, and the electrode layer 40 further on the upper surface thereof. These layers will play roles of electrodes and/or black stripes.

Transparent Substrate

The transparent substrate 10 is not particularly limited so long as it is made of a material which transmits a second laser beam described later (a material having a transmittance of at least 80% in the present invention). In the above-mentioned removing step, an unnecessary mask layer 20 can be removed therefrom by application of a laser beam from the transparent substrate 10 side (the lower surface side) on which the mask layer 20, the first antireflection layer 30, the second antireflection layer 32 and the electrode layer 40 are not formed. As a specific example thereof, a glass substrate may preferably be mentioned. Particularly preferred is a glass substrate having a thickness of from about 0.7 to 3 mm which has been used heretofore as a glass substrate for PDP.

Mask Layer-Forming Step

In the preferred embodiment of the method for forming electrodes and/or black stripes for a plasma display substrate of the present invention, in the mask layer-forming step, the mask layer 20 is formed on the surface of the above transparent substrate 10.

The mask layer 20 is not particularly limited so long as it is made of a material which can be removed by irradiation with a first laser beam described later, or which undergoes so-called ablation (hereinafter sometimes referred to simply as "mask layer-forming material").

As such a mask layer-forming material, an organic material is preferred, since it is thereby possible to form openings and carry out the peeling sufficiently even by a first laser beam with a low energy density.

As such an organic material, an epoxy resin, a polyethylene resin, a polyimide resin, a polyester resin, an ethylene tetrafluoride resin or an acrylic resin may, for example, be mentioned.

By using such an organic material, in the opening-forming step described later, it is possible to form openings certainly without permitting the mask layer 20 to remain on the surface of the transparent substrate 10 at the openings, simply by applying from 1 to 5 pulses of a first laser beam 14 having a wavelength of from 500 to 1,500 nm and an energy density of from 0.1 to 5 J/cm$^2$.

Further, also in the removing step described later, it is possible to certainly remove the mask layer 20 from the transparent substrate 10 without damaging the first antireflection layer 30, the second antireflection layer 32 and the electrode layer 40 which are to remain on the transparent substrate 10, simply by applying from 1 to 5 pulses of a second laser beam 15 having a wavelength of is from 500 to 1,500 nm and an energy density of from 0.1 to 5 J/cm$^2$.

Further, the above mask layer is preferably made of a mask layer-forming material containing from 10 to 99 mass %, preferably from 20 to 99 mass % of a pigment or dye. The pigment or dye is preferably a black pigment or black dye.

Here, the black pigment (dye) is not particularly limited so long as it is a compound capable of increasing the absorption efficiency of the mask layer with respect to the first or second laser beam. As a specific example, carbon black, titanium black, bismuth sulfide, iron oxide, an azo acid dye (such as C.I. Mordant Black 17), a disperse dye or a cationic dye may preferably be mentioned. Among them, carbon black and titanium black are preferred since they have a high absorption coefficient with respect to all kinds of laser beams.

By using a mask layer-forming material containing from 10 to 99 mass % of such a black pigment (dye), it is possible to increase the absorption coefficient with respect to the first laser beam or the second laser beam described later, whereby it is possible to form openings or to carry out the removing step sufficiently even by a laser beam with a low energy density (e.g. at a level of from 0.1 to 1 J/cm$^2$). It is thereby possible to easily and certainly remove only an unnecessary mask layer 20 without presenting any damage to the first antireflection layer 30, the second antireflection layer 32 and the electrode layer 40 remaining on the substrate, so that the mask layer 20 will not remain on the substrate.

Accordingly, by using a material containing such a black pigment (dye) as the mask layer-forming material, in the opening-forming step described later, it is possible to certainly form openings without permitting the mask layer 20 to remain on the surface of the transparent substrate 10 at the openings, simply by applying from 1 to 5 pulses of the first laser beam 14 having a wavelength of from 500 to 1,500 nm and an energy density of from 0.1 to 5 J/cm$^2$. Further, when the above-mentioned organic material containing such a black pigment (dye) is used as the mask layer-forming material, the same effects can be obtained simply by applying from 1 to 5 pulses of the first laser beam 14 having a wavelength of from 500 to 1,500 nm and an energy density of from 0.1 to 1 J/cm$^2$.

Further, by using a material containing such a black pigment (dye) as a mask layer-forming material, also in the removing step described later, it is possible to certainly remove the mask layer 20 from the transparent substrate 10 without presenting any damage to the first antireflection layer 30, the second antireflection layer 32 and the electrode layer 40 which are to remain on the transparent substrate 10, simply by applying from 1 to 5 pulses of the second laser beam 15 having a wavelength of from 500 to 1,500 nm and an energy density of from 0.1 to 5 J/cm$^2$. Further, when the above-mentioned organic material containing such a black pigment (dye) is used as the mask layer-forming material, the same effects can be obtained simply by applying from 1 to 5 pulses of the second laser beam 15 having a wavelength of from 500 to 1,500 nm and an energy density of from 0.1 to 1 J/cm$^2$.

Further, the above mask layer is made to have an absorption coefficient with respect to the second laser beam 15 which is larger by, preferably at least twice, more preferably at least three times, further preferably at least five times, than the absorption coefficient of the after-mentioned antireflection layer with respect to the second laser beam 15. It is thereby possible to obtain an effect such that in the removing step described later, only an unnecessary mask layer can be more readily and more certainly be removed.

Further, the absorption coefficient of the mask layer with respect to the first laser beam 14 is preferably at least 70%, more preferably at least 85%, whereby laser processing can be carried out efficiently.

Such a mask layer 20, may, for example, be formed by a commonly employed method, such as a method of applying the above-mentioned mask layer-forming material onto the surface of the transparent substrate 10 by means of e.g. a coater, or a method of forming the above-mentioned mask layer-forming material of a film shape on the surface of the transparent substrate 10 by means of e.g. a film laminator.

The thickness of such a mask layer 20 is preferably from about 5 to 20 μm, more preferably from about 10 to 20 μm. In a conventional wet system, the thickness of the mask layer 20 is usually from about 25 to 50 μm. Whereas, in the case of the present invention employing a laser beam, the above-mentioned thickness is suitable for such reasons that it is suitable to produce fine electrodes more certainly with higher precision, and processing can be carried out by a smaller laser energy, whereby the mass productivity can be substantially improved.

Opening-Forming Step

In the preferred embodiment of the method for forming electrodes and/or black stripes for a plasma display substrate of the present invention, in the opening-forming step, the mask layer 20 formed on the transparent substrate 10 in the above mask layer-forming step, is evaporated and removed to form openings, by using ablation and thermal energy in combination by means of e.g. excimer laser beam or YAG laser beam as the first laser beam 14.

In the present invention, the openings preferably have an overhang shape or an inversely tapered shape.

In such a shape, the first antireflection layer 30, the second antireflection layer 32 and the electrode is layer 40, etc., can easily be formed more precisely.

In a case where openings are to be formed in the mask layer 20 by applying such a first laser beam 14 to the mask layer 20 from the lower surface side, the first laser beam 14 entering into the mask layer usually has its energy attenuated as it penetrates into the interior of the mask layer 20, whereby openings will be formed so that their cross-sectional shape will be an inversely tapered shape. The inversely tapered shape is a shape wherein the size of an opening in the mask layer 20 gradually increases toward the transparent substrate 10.

Further, it is possible to form openings of an overhang shape by applying the first laser beam 14 to the mask layer 20 from the upper surface side. The overhang shape means a state wherein openings are to be formed on the mask layer 20 consisting of e.g. two layers, the size of openings in the upper layer is smaller than the size of openings in the lower layer. Namely, it is a shape wherein the edges of openings in the upper layer stick out in comparison with edges of openings in the lower layer.

Now, the method for forming openings by processing the mask layer by means of the first laser beam 14 will be described in detail. FIGS. 3 to 5 illustrate process steps for processing an opening in a mask layer 20 formed on a transparent substrate 10 so that its cross-sectional shape will be an inversely tapered shape or an overhang shape.

In this detailed description, the mask layer-forming material, the mask layer-forming method and the thickness, etc. of the mask layer are the same as described in the above mask layer-forming step.

Firstly, the step of forming an opening of an overhang shape shown in FIG. 3 will be described. On a transparent substrate 10, a liquid mask layer-forming material is applied or a film-shaped mask layer-forming material is laminated to form a first mask layer 20*a* (FIG. 3(*a*)). And, from the mask layer 20*a* side, a first laser beam 14 is applied via a photomask 12 (FIG. 3(*b*)) to form an opening (FIG. 3(*c*)). The cross-sectional shape of this opening is gradually narrowed towards the surface of the transparent substrate 10 to have a so-called regularly tapered shape. Then, on the upper surface of this first mask layer 20*a*, a film-shaped mask layer-forming material is laminated to form a second mask layer 20*b* (FIG. 3(*d*)). And, from the mask layer 20*b* side, a first laser beam 14 is applied via a photomask 12 (FIG. 3(*e*)) to form an opening (FIG. 3(*f*)). Formation of the opening in the second mask layer 20*b* is carried out so that the size of the opening will be smaller than the size of the opening formed in the first mask layer 20*a*. Thus, it is possible to form an opening having an overhang shape as shown in FIG. 3(*f*), wherein at the opening, the edges of the second mask layer 20*b* protrude beyond the edges of the first mask layer 20*a*. And, when a first antireflection layer 30 is formed in the following antireflection layer-forming step as described later, the cross-section will be as shown in FIG. 3(*g*).

Further, as a method for processing the mask layer 20 into an overhang shape by means of the first laser beam 14, other than the above method of forming the mask layer 20 into two layers, a method may be employed wherein irradiation is carried out twice by changing the focus position of the first laser beam 14. Such a process will be described in detail with reference to FIG. 4. Firstly, on a transparent substrate 10, a liquid mask layer-forming material is applied or a film-shaped mask layer-forming material is laminated to form a mask layer 20 (FIG. 4(*a*)). And, from the upper surface side of the mask layer 20, a first laser beam 14 is applied via a photomask 12 (FIG. 4(*b*)) whereby the mask layer 20 will be processed to have a regularly tapered shape (FIG. 4(*c*)). Then, the focus of the first laser beam 14 is moved, and the first laser beam 14 is again applied via a photomask 12 (FIG. 4(*d*)), whereby the cross-sectional shape of the opening in the mask layer 20 will be a shape having the regularly tapered shape processed from a half way into an inversely tapered shape (FIG. 4(*e*)). Namely, since the mask layer has already been processed into a regularly tapered shape by the first laser beam irradiation, at the time of the second laser beam irradiation, there is no mask layer-forming material which absorbs the energy of the first laser beam 14, and the energy will be applied to the mask layer-forming material in the transverse direction in the vicinity of the focus close to the upper surface of the transparent substrate 10. And, when a first antireflection layer 30 is formed in the following antireflection layer-forming step as described later, the cross-section will be as shown in FIG. 4(*f*).

Now, a method for processing a mask layer 20 into an inversely tapered shape will be described in detail with reference to FIG. 5.

Firstly, on a transparent substrate 10, a liquid mask layer-forming material is applied or a film-shaped mask layer-forming material is laminated to form a mask layer 20 (FIG. 5(*a*)). And, from the lower surface side of the transparent substrate 10, a first laser beam 14 is applied via a photomask 12 (FIG. 5(*b*)), whereby the mask layer 20 is processed by the first laser beam 14 passed through the transparent substrate 10 so that in the mask layer 20, an opening is formed with a cross-sectional shape being an inversely tapered shape (FIG. 5(*c*)). And, when a first antireflection layer 30 is formed in the following antireflection layer-forming step as described later, the cross-section will be as shown in FIG. 5(*d*).

This method is a method whereby an opening of an inversely tapered shape can be formed most efficiently, since the opening of an inversely tapered shape can certainly be formed by only one laser beam irradiation.

By using either one or a combination of such methods, it is possible to form in the mask layer 20 openings having a cross-sectional shape being an overhang shape or an inversely tapered shape.

To form openings in the opening-forming step of the present invention, the first laser beam 14 to be employed is a laser beam having wavelength of from 500 to 1,500 nm and an energy density of from 0.1 to 5 J/cm$^2$, preferably from 0.5 to 3 J/cm$^2$. The first laser beam may be pulses or CW (continuous wave).

Such a laser beam may specifically be, for example, YAG laser beam (wavelength: 1,064 nm) or YAG laser beam (wavelength: 532 nm).

By applying such a first laser beam 14 to the mask layer 20 made of the above-mentioned material, it is possible to certainly form openings of an overhang shape or an inversely tapered shape by irradiation in a very short time without permitting the mask layer 20 to remain on the surface of the transparent substrate 10 at the openings.

Antireflection Layer-Forming Step

In the preferred embodiment of the method for forming electrodes and/or black stripes for a plasma display substrate of the present invention, in the antireflection layer-forming step, on the transparent substrate 10, an antireflection layer is formed which has a double layer structure comprising a first antireflection layer 30 made of chromium oxide and having a prescribed thickness and a second antireflection layer 32 made of Cr.

By forming the first antireflection layer 30 on the transparent substrate 10 and forming the second antireflection layer 32 on the upper surface thereof to have the double layer structure, lights reflected from the respective layers will interfere to lower the reflectance thereby to have a clear image displayed.

First Antireflection Layer

In the preferred embodiment of the present invention, the material for the first antireflection layer is preferably made of chromium oxide and/or titanium oxide. When the content of chromium oxide and/or titanium oxide (the total content of chromium oxide and titanium oxide) is at least 95 mass %, based on the entire material constituting the first antireflection layer 30, such a material is preferred for the antireflection layer of the present invention.

Here, chromium oxide means oxygen-deficient type $CrO_X$ ($1.0 \leqq X < 1.5$), $Cr_2O_3$ or the like. The chromium oxide is particularly preferably oxygen-deficient type $CrO_X$ ($1.0 \leqq X < 1.5$), whereby the reflection characteristic will be good.

Further, titanium oxide means oxygen-deficient type $TiO_X$ ($1.0 \leqq X < 2.0$), $TiO_2$ or the like. The titanium oxide is particularly preferably oxygen-deficient type $TiO_X$ ($1.0 \leqq X < 2.0$), whereby the reflection characteristic will be good.

Further, the chromium oxide and/or the titanium oxide may further contain carbon, nitrogen or the like. Particularly, by incorporating carbon and/or nitrogen to the material for forming the first antireflection layer 30, the extinction coefficient and the refractive index of the film can finely be adjusted, and by adjusting them properly to the optical characteristics of the second antireflection layer 32, the antireflection property can be made to be good within a range of from the visible light region to the laser wavelength region to be used in the present invention. In a case where nitrogen is incorporated to the chromium oxide, the composition of such chromium oxynitride film is preferably represented by $Cr_{1-Y-Z}O_YN_Z$ wherein $0.3 \leqq Y \leqq 0.55$, and $0.03 \leqq Z \leqq 0.2$.

In the present invention, the thickness of the first antireflection layer 30 is preferably from 30 nm to 100 nm. If the thickness is outside this range, it tends to be difficult to lower the reflectance by utilizing the interference of the reflected lights. The thickness may be optionally adjusted within such a range depending upon the refractive index, the extinction coefficient, etc. of the film.

Further, the first antireflection layer 30 is preferably substantially transparent and has a refractive index at a wavelength of 550 nm being preferably from 1.9 to 2.8, more preferably from 1.9 to 2.4. If the refractive index is outside this range, it tends to be difficult to let reflected lights from the first antireflection layer 30 and the second antireflection layer 32 interfere with each other to reduce the reflectance. Here, "substantially transparent" means that the extinction coefficient is at most 1.5, more preferably at most 0.7, whereby sufficient interference of lights can be caused.

Further, the first antireflection layer 30 may be made of a plurality of films. Specifically, it may be one having chromium oxide and chromium nitride sequentially laminated from the substrate side.

Second Antireflection Layer

In the preferred embodiment of the present invention, the second antireflection layer 32 is made of Cr and/or Ti. When the content of Cr and/or Ti is at least 95 mass % based on the entire material for forming the second antireflection layer 32, such material performs a function as the antireflection layer of the present invention. Further, it is preferred that the second antireflection layer 32 is made of Cr and/or Ti in that it is thereby possible to protect a thin film layer as described later.

Further, Cr and/or Ti may further contain carbon, is nitrogen or the like. Particularly, by incorporating carbon and/or nitrogen to the material for forming the second antireflection layer 32, the extinction coefficient and the refractive index of the film can finely be adjusted, and by adjusting them properly to the optical characteristics of the first antireflection layer 30, the antireflection property can be made good within a range of from visible light region to the laser wavelength region to be used in the present invention.

The second antireflection layer 32 of the present invention is made to have a low light transmittance and to be substantially opaque in the visible light region. To be made to be substantially opaque, the visible light transmittance may be made usually from 0.0001 to 0.1%. Specifically, the thickness is made to be from 10 to 200 nm, preferably from 20 to 100 nm.

To form the first antireflection layer 30 and the second antireflection layer 32 of the present invention, conventional sputtering or vacuum evaporation may be employed. In order to form a Cr layer for the second antireflection layer 32 by sputtering, the sputtering may be carried out by using a chromium target in an inert atmosphere such as argon. The same will apply to a case where Ti layer is to be formed. Here, sputtering can be carried out by mixing $N_2$ or $CH_4$ to argon or the like. Further, in order to form a chromium oxide layer for the first antireflection layer 30, it is possible to employ a method of carrying out sputtering by using a chromium target in an atmosphere containing oxygen, or a method of using a chromium oxide target. The same will apply in a case where a titanium oxide layer is to be formed. Here, sputtering may be carried out by mixing $N_2$, $CO_2$, $CH_4$, etc.

In order to bring the thicknesses of the first antireflection layer 30 and the second antireflection layer 32 to be formed on the transparent substrate 10 to the above-mentioned levels, it is possible to adjust them by controlling the reaction time, etc. by the sputtering or vapor deposition.

In a case where the first antireflection layer 30 and the second antireflection layer 32 are to be formed on the upper surface side of the transparent substrate having the mask layer 20 formed, by such a method, in the mask layer 20, the transparent substrate 10 is exposed at the opening portions formed in the above opening-forming step, and at such opening portions, the first antireflection layer 30 and the second antireflection layer 32 will be formed on the surface (upper surface) of the transparent substrate 10. At other portions i.e. other than the opening portions, the first antireflection layer 30 and the second antireflection layer 32 will be formed on the upper surface of the mask layer 20.

The pattern width of the display pixel region of the first antireflection layer 30 and the second antireflection layer 32 formed on the transparent substrate 10 is preferably determined taking the balance of the desired contrast and the luminance into consideration, and it is, for example, at most 30 μm. If it is too wide, light emitted from the PDP display device itself will be shielded, whereby no adequate luminance tends to be secured.

The antireflection layer-forming step in the preferred embodiment of the method for forming electrodes and/or black stripes for a plasma display substrate of the present invention, is not limited to one wherein two layers of the first antireflection layer 30 and the second antireflection layer 32 are formed as exemplified in the above preferred embodiment. In addition to such two layers, a plurality of layers may further be formed.

Electrode Layer-Forming Step

In the preferred embodiment of the method for forming electrodes and/or black stripes for a plasma display substrate of the present invention, in the electrode layer-forming step, an electrode layer 40 is formed on the upper surface side of the second antireflection layer 32.

The material for the electrode layer-forming material to constitute the electrode layer 40 is not particularly limited so long as it performs the function as an electrode. For example, copper, silver, aluminum or gold may be used. Among them, copper is preferred, since the electroconductivity is high, and it is inexpensive as a material.

The method for forming the electrode layer 40 by using an electrode layer-forming material made of such a material, is the same as the method described in the above antireflection layer-forming step. By such a method, the electrode layer 40 can be formed. The thickness of the electrode layer 40 is usually from about 1 to 4 μm. The method for adjusting such a thickness is also the same as the method described in the above antireflection layer-forming step.

When such an electrode layer 40 is used together with the above-mentioned antireflection layer as electrodes and/or black stripes for a plasma display substrate, the electrodes and/or the black stripes may sometime be covered with a dielectric. The durability of the electrodes and/or the black stripes of the present invention against the dielectric is remarkably high as compared with ITO, and the degree to be eroded is also very low. However, by the following two methods, the electrodes can be made to be more hardly eroded, such being preferred.

The first method is a method which includes a Cr/Ti layer-forming step to form a layer made of Cr and/or Ti after the electrode layer-forming step, whereby on the upper surface of the electrode layer 40, a layer made of Cr and/or Ti is further formed as a protective layer. By such a protective layer, there will be no possibility is that the dielectric will be in direct contact with the electrode layer 40, whereby the electrode layer 40 will hardly be eroded.

The method for forming such a layer made of Cr and/or Ti is the same as the method for forming the first antireflection layer and the second antireflection layer.

The thickness of the layer made of Cr and/or Ti may be from 0.05 to 0.2 μm. With such a thickness, it is possible to prevent or suppress erosion of the electrode layer 40 by the dielectric. Also the method for adjusting the thickness to such a level, is also the same as the method for forming the first antireflection layer and the second antireflection layer.

The second method is a method of incorporating Cr and/or Ti to the above electrode layer 40. Cr is highly resistant against the dielectric. Specifically, the electrode layer 40 may be made to be a layer which is made of an alloy of Cr and/or Ti and Cu.

It is preferred that Cr and/or Ti is contained in an amount of from 5 to 15 mass % based on the entire material constituting the electrode layer 40, whereby the electrode layer 40 has adequate durability against the dielectric, and the electrical conductivity can be maintained.

To form such an electrode layer containing Cr and/or Ti, the same method as the method for forming the above antireflection layer may be applied by using the above-mentioned electrode layer-forming material containing Cr and/or Ti.

Removing Step

In the preferred embodiment of the method for forming electrodes and/or black stripes for a plasma display substrate of the present invention, in the removing step, a second laser beam 15 is applied to the above mask layer 20 to remove the mask layer 20 from the transparent substrate 10. When the second laser beam 15 is applied to the mask layer 20, the mask layer 20 will be evaporated by a combination of ablation and thermal energy. As a result, the mask layer 20 will be removed from the transparent substrate 10. Here, as the type of the second laser beam 15, an excimer laser beam or a YAG laser beam may, for example, be employed in the same manner as the above-mentioned first laser beam 14.

Further, the intensity of the second laser beam 15 is, like the first laser beam 14, such that the wavelength is from 500 to 1,500 nm and the energy density is from 0.1 to 5 J/cm$^2$. When the intensity of the second laser beam 15 is within this range, the mask layer 20 can certainly be removed from the transparent substrate 10 without leaving a damage to the first antireflection layer 30, the second antireflection layer 32 and the electrode layer 40 remaining on the transparent substrate 10, as mentioned above.

The types and intensities of the first laser beam 14 and the second laser beam 15 may be the same or different. They are preferably the same, when the cost of the apparatus, etc. are taken into consideration.

Further, in FIG. 2(*g*), the first antireflection layer 30, the second antireflection layer 32 and the electrode layer 40 are formed on the mask layer 20. In such a case, it is preferred to apply the second laser beam 15 from the lower surface side of the transparent substrate 10, whereby the mask layer 20 can be removed from the transparent substrate 10 more certainly and with little residue.

Further, in the method for forming electrodes and/or black stripes for a plasma display substrate of the present invention, in the removing step, a film with an adhesive agent may be bonded on the electrode layer 40, and then, the mask layer 20 may together be removed from the transparent substrate 10.

Adhesion Reducing Step

Further, in order to reduce or eliminate the adhesion between the mask layer 20 and the transparent substrate 10 (hereinafter such may be generally referred to simply as "reducing the adhesion"), a step of reducing the adhesion by light (hereinafter referred to as "adhesion reducing step") may be provided immediately before the removing step. Namely, after forming the first antireflection layer 30, the second antireflection layer 32 and the electrode layer 40 on the mask layer 20, is light is applied from the transparent substrate 10 side (the lower surface side). Here, the light is preferably an ultraviolet light. The mask layer-forming material will thereby be decomposed and degraded. As a result, the adhesion between the mask layer 20 and the transparent substrate 10 will be reduced. Accordingly, in such a case, as the mask layer-forming material, a material containing a component which undergoes decomposition or degradation under irradiation with light, may be employed. Further, in a case where the type of the mask layer-forming material is different, irradiation may be carried out by using a light having a wavelength corresponding to the particular mask layer-forming material.

It is thereby possible to make the mask layer 20 readily removable from the transparent substrate 10, and the residue after the removal can be reduced.

Thin Film Layers

In the present invention, a plurality of thin film layers (plural layers) may further be formed in addition to the above-mentioned first antireflection layer 30, second antireflection layer 32 and electrode layer 40. For example, in a case where one thin-layer is to be further formed, a thin film layer is further formed on the upper surface of the transparent substrate 10 before the mask layer-forming step or after the removing step, and a third laser beam is applied to the thin film layer to directly remove a part of the thin film layer (direct patterning). By utilizing such direct patterning, a thin film layer can easily be formed.

Further, in a case where a thin film layer is formed after the above removing step, direct patterning of the thin film layer by irradiation with the third laser beam as described later, may be applied to the thin film layer formed on the transparent substrate 10 and on the electrode layer 40, particularly to the portion of the thin film layer directly formed on the transparent substrate 10.

On the other hand, in a case where a thin film layer is formed before the above mask layer-forming step, direct patterning of the thin film layer by irradiation with the third laser beam as described later, may be carried out before formation of the mask layer to form the first antireflection layer 30, the second antireflection layer 32 and the electrode layer 40 (i.e. in the state where only the thin film layer is formed on the transparent substrate 10), or may be carried out after forming the electrode layer 40 (i.e. after the first antireflection layer 30, the second antireflection layer 32 and the electrode layer 40 are formed on the thin film layer). Here, in a case where the thin film layer is formed before the mask layer-forming step, if the direct patterning of the thin film layer is carried out after forming the first antireflection layer 30, the second antireflection layer 32 and the electrode layer 40, the mask layer to form the first antireflection layer 30, the second antireflection layer 32 and the electrode layer 40, may be formed only on the thin film layer before processing i.e. not on the transparent substrate 10, whereby it becomes possible to form a pattern more efficiently with higher precision.

The third laser beam for the direct patterning of the thin film layer may, for example, be an excimer laser beam or a YAG laser beam, and it is preferred to employ a laser beam which has an energy density higher than the first laser beam or the second laser beam (the laser beams having a wavelength of from 500 to 1,500 nm and an energy density of from 0.1 to 5 J/cm$^2$) to be used for the above-mentioned forming of openings or removal of the mask layer and which has a wavelength of from 500 to 1,500 nm and an energy density of from 6 to 40 J/cm$^2$.

Further, the material which may be used for the thin film layer may be any material so long as the above-mentioned thin film layer can be removed directly by irradiation with the third laser beam for direct patterning. Specifically, an oxide such as $In_2O_3$ or $SnO_2$, a metal such as Cr or Ti, or its oxide may, for example, be mentioned. Namely, the material for the thin film layer and the third laser beam to be used may suitably be selected depending upon their combination.

Such a thin film layer may be formed by the same is method as for the formation of the first antireflection layer 30, the second antireflection layer 32 and the electrode layer 40. The thickness of the thin film layer is usually at a level of 0.2 μm, and the method for adjusting such a thickness is the same as in the case of the first antireflection layer, the second antireflection layer and the electrode layer 40.

Further, in the present invention, for example, the order of the respective steps in the above preferred embodiment may be optionally changed, or a step of forming another thin film may be added.

Further, the present invention provides a plasma display substrate provided with electrodes and/or black stripes, having a first antireflection layer made of chromium oxide and/or titanium oxide, a second antireflection layer made of Cr and/or Ti, and an electrode layer made of Cu, and such a plasma display substrate can be produced by the above-described method for forming electrodes and/or black stripes for a plasma display substrates.

In the plasma display substrate provided with electrodes and/or black stripes of the present invention, the first antireflection layer, the second antireflection layer and the electrode layer are laminated in this order on the substrate, but another layer may be formed between the adjacent layers.

The front substrate of plasma display provided with electrodes and black stripes for a plasma display substrate, produced by the above method for forming electrodes and/or black stripes for a plasma display substrate, will be described with reference to FIGS. 6 and 7.

Figure 6:
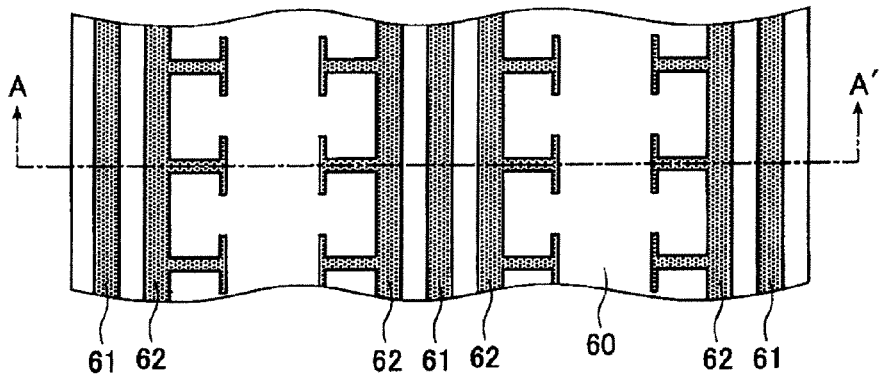
FIG. 6 is a schematic plan view of a substrate provided with electrodes and/or black stripes for a plasma display substrate, formed by a preferred embodiment of the method for forming electrodes and/or black stripes for a plasma display substrate of the present invention.

FIG. 6 shows an example of transparent substrate 60 provided with electrodes 62 and black stripes 61 for a plasma display substrate, which is formed by the method for forming electrodes and/or black stripes for a plasma display substrate of the present invention. Further, FIG. 7 shows a cross-sectional view along line A-A' in FIG. 6.

Figure 7:
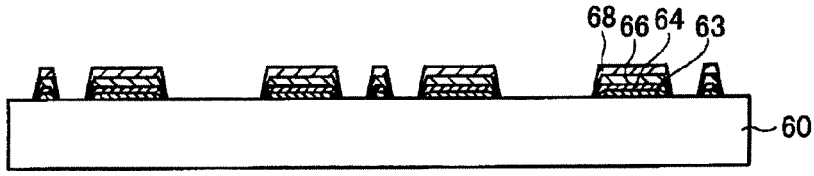
FIG. 7 is a schematic view of the cross-section along line A-A' of the schematic plan view of the substrate provided with electrodes and/or black stripes for a plasma display substrate formed in a preferred embodiment of the method for forming electrodes and/or black stripes for a plasma display substrate of the present invention.

As shown in FIG. 7, on the upper surface of the transparent substrate 60, a first antireflection layer 63, a second antireflection layer 64, an electrode layer 66 and a protective layer 68 are formed in this order. By taking such a layered structure, an antireflection layer is formed not only for black stripes, but also for bus electrodes and display electrodes, whereby reflection of e.g. outside light can better be suppressed, and a clearer image can be formed on a PDP display device employing such a layered structure.

The visible light reflectance of the entirety of these layers from the substrate side (the transparent substrate 60 side) is preferably at most 50%, particularly preferably at most 40%, further preferably at most 10%. When the visible light reflectance can be brought within such a range, it is possible to form a clearer image on a PDP display device employing such a reflectance.

Further, for the electrodes for a plasma display panel of the present invention, electrode layers used to be employed as bus electrodes, are used also as display electrodes, and it is therefore unnecessary to firstly form display electrodes consisting of transparent electrodes and then form bus electrodes at portions of such display electrodes, as required for conventional electrodes for a plasma display substrate. Accordingly, it is possible to produce electrodes for a plasma display substrate in a shorter time at lower costs and more certainly.

Further, the electrodes and black stripes can be prepared in the same step, whereby a substantial cost down can be expected.

Accordingly, PDP employing a plasma display substrate provided with the electrodes for a plasma display substrate of the present invention may likewise be produced at lower costs.

Further, by the method for forming the electrodes for a plasma display substrate of the present invention, it is possible to produce a rear substrate of plasma display provided with address electrodes. Further, by using such a rear substrate of plasma display, it is also possible to produce PDP.

Embodiment

Now, the present invention will be described in further detail with reference to an Embodiment, but it should be understood that the present invention is by no means thereby restricted.

The method for forming electrodes and/or black stripes for a plasma display substrate according to the Embodiment will be described with reference to FIGS. 8 to 10.

In this Embodiment, as the mask layer, a film made of a mask layer-forming material of an acrylic resin containing 40 mass % of carbon black (hereinafter referred to simply as "a mask film") is used; as the first antireflection layer-forming material, metal Cr (purity: at least 99.99%) is used; as the second antireflection layer-forming material, metal Cr (purity: at least 99.99%) is used; as the electrode layer-forming material, metal copper (purity: at least 99.99%) is used; and as the protective layer-forming material, metal Cr (purity: at least 99.99%) is used.

Figure 8A:
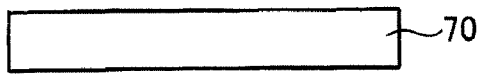
FIGS. 8(*a*) to (*c*) are cross-sectional views showing schematic constructions of a plasma display substrate and a production apparatus to show steps for forming electrodes and/or black stripes for a plasma display device in the Embodiment.
Figure 8B:
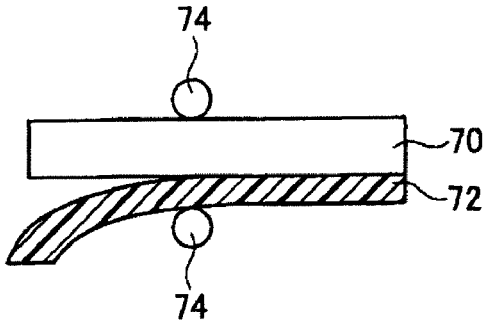
Figure 8C:
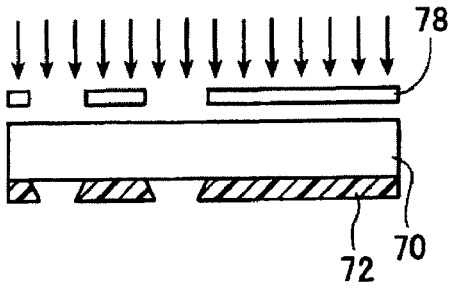
Figure 9D:
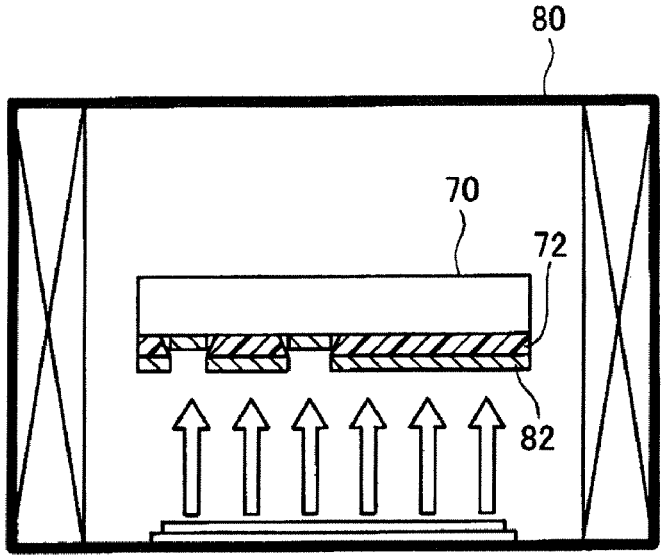
FIGS. 9(*d*) to (*e*) are cross-sectional views showing schematic constructions of a plasma display substrate and a production apparatus to show steps for forming electrodes and/or black stripes for a plasma display substrate in the Embodiment.
Figure 9E:
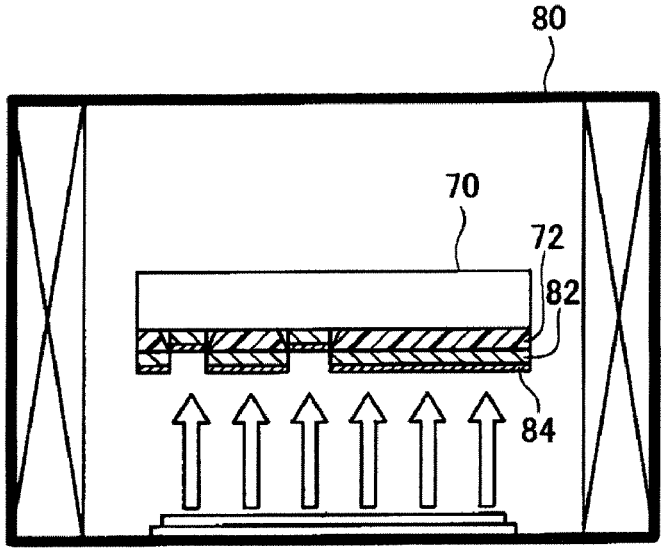
Figure 10F:
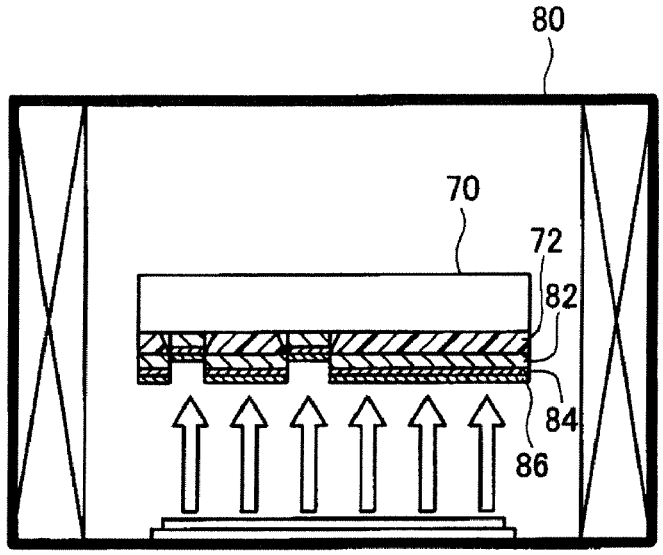
FIGS. 10(*f*) to (*h*) are cross-sectional views showing schematic constructions of a plasma display substrate and a production apparatus to show steps for forming electrodes and/or black stripes for a plasma display substrate in the Embodiment.
Figure 10G:
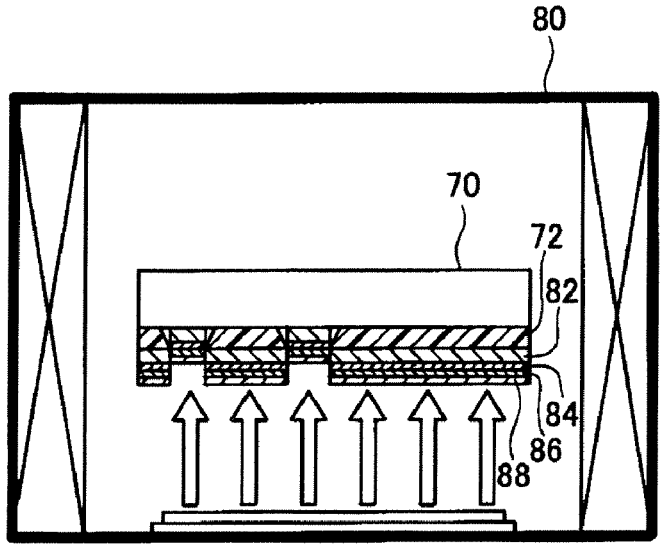
Figure 10H:
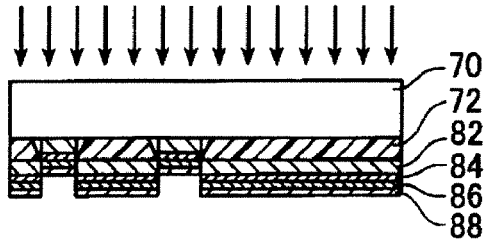
Figure 11:
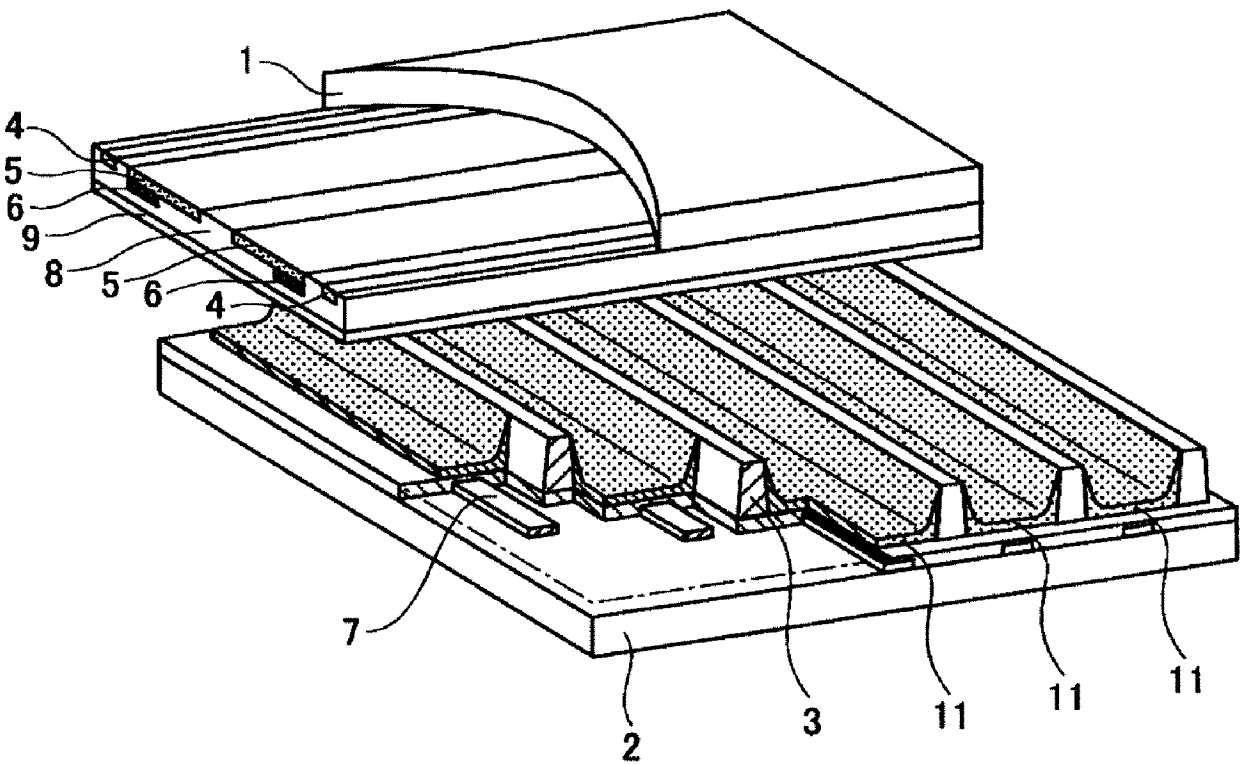
FIG. 11 is a schematic view showing a schematic construction of conventional PDP.

The mask film as well as the first antireflection layer, the second antireflection layer, the electrode layer and the protective layer, are formed by the steps for forming electrodes and/or black stripes for a plasma display substrate as shown in FIGS. 8 to 10.

As shown in FIGS. 8 to 10, the method for forming electrodes and/or black stripes for a plasma display substrate according to the Embodiment comprises (1) a mask film-bonding step (FIGS. 8(*a*) and (*b*)), (2) an opening-forming step by irradiation with a laser beam (FIG. 8(*c*)), (3) antireflection layer-forming steps (FIGS. 9(*d*) and (*e*)), (4) electrode layer and protective layer-forming steps (FIGS. 10(*f*) and (*g*)), and (5) a step for removing the mask layer by irradiation with a laser beam (FIG. 10(*h*)).

Specifically, firstly, on a glass substrate 70 (FIG. 8(*a*)), a mask film 72 having a thickness of 15 μm is uniformly bonded by a film laminator 74 (FIG. 8(*b*)). Then, to the glass substrate 70, a YAG laser beam having a wavelength of 1,064 nm and an energy density of 1 J/cm$^2$ is applied as the first laser beam via photomask 78 (FIG. 8(*c*)). By the irradiation, the cross-sectional shape of the openings of the mask film 72 will be an inversely tapered shape. Then, this glass substrate 70 is put in a sputtering film deposition device 80, and on the glass substrate 70 and the mask film 72, a $CrO_{1.3}$ layer is formed as the first antireflection layer 82 by sputtering film deposition (FIG. 9(*d*)). The thickness of this first antireflection layer is 0.05 μm, and the first antireflection layer 82 is formed on the mask film 72 and on the glass substrate 70 completely separately. Further, by using the same sputtering film deposition device 80, on the first antireflection layer 82, a Cr layer as the second antireflection layer 84, a Cu layer as the electrode layer 86 and a Cr layer as the protective layer 88 are formed in this order by sputtering for film deposition (FIG. 9(*e*) to FIG. 10(*g*)). The thicknesses of the respective layers are such that the second antireflection layer 84 is about 0.08 μm, the electrode layer 86 is about 3 μm, and the protective layer 88 is about 0.1 μm.

The respective layers are formed on the mask film 72 and on the glass substrate 70 completely separately.

And finally, as the second laser beam, a YAG laser beam having a wavelength of 1,064 nm and an energy density of 0.25 J/cm$^2$ is applied to the mask film 72 from the side of the glass substrate 70 to remove the mask film 72 from the glass substrate 70 (FIG. 10(*h*)).

By the foregoing steps, it is possible to form electrodes and/or black stripes for a plasma display substrate similar to those shown in FIGS. 6 and 7. Further, such display electrodes have a resistance equal to or lower than ITO and have an excellent contrast. Further, no erosion by a dielectric is observed.

INDUSTRIAL APPLICABILITY

According to the present invention, electrodes or black stripes can be formed on a transparent substrate by the same material i.e. a material which is inexpensive, has a low resistance and is less susceptible to erosion by a dielectric, thereby to prepare a plasma display substrate, and further, by using such a plasma display substrate, it is possible to produce a plasma display device which is capable of displaying a clear image.

The entire disclosure of Japanese Patent Application No. 2004-279497 filed on Sep. 27, 2004 including specification, claims, drawings and summary is incorporated herein by reference in its entirety.

What is claimed is:

1. A method for forming electrodes for a plasma display substrate, comprising:

forming a mask layer on a transparent substrate;

forming openings in the mask layer by applying a first laser beam;

forming an antireflection layer on the transparent substrate and on the mask layer, the antireflection layer comprising a first antireflection layer and a second antireflection layer and being configured to lower reflectance by interference of lights reflected from respective ones of the first antireflection layer and the second antireflection layer, the first antireflection layer being substantially transparent and having a refractive index at a wavelength of 550 nm in a range from 1.9 to 2.8, the second antireflection layer comprising at least one of Cr and Ti;

forming an electrode layer on an upper surface side of the antireflection layer; and removing the mask layer from the transparent substrate.

2. The method for forming electrodes for a plasma display substrate according to claim 1, wherein in the removing, the mask layer is removed from the transparent substrate by applying a second laser beam.

3. The method for forming electrodes for a plasma display substrate according to claim 2, wherein the mask layer has an absorption coefficient with respect to the second laser beam, which is at least twice an absorption coefficient of the antireflection layer with respect to the second laser beam.

4. The method for forming electrodes for a plasma display substrate according to claim 1, wherein the first antireflection layer comprises at least one of chromium oxide and titanium oxide.

5. The method for forming electrodes for a plasma display substrate according to claim 1, wherein the mask layer comprises an organic material.

6. The method for forming electrodes for a plasma display substrate according to claim 1, wherein the mask layer is made of a material containing from 10 to 99 mass % of one of a black pigment and black dye.

7. The method for forming electrodes for a plasma display substrate according to claim 6, wherein the second laser beam is a laser beam having a wavelength of from 500 to 1,500 nm and an energy density of from 0.1 to 1 J/cm$^2$.

8. The method for forming electrodes for a plasma display substrate according to claim 1, wherein the mask layer has a layer thickness of from 5 to 20 μm.

9. The method for forming electrodes for a plasma display substrate according to claim 1, wherein the first laser beam is a laser beam having a wavelength of from 500 to 1,500 nm and an energy density of from 0.1 to 5 J/cm$^2$.

10. The method for forming electrodes for a plasma display substrate according to claim 1, wherein the mask layer has an absorption coefficient of at least 70% with respect to the first laser beam.

11. The method for forming electrodes for a plasma display substrate according to claim 1, wherein the openings have an overhang shape or an inversely tapered shape.

12. The method for forming electrodes for a plasma display substrate according to claim 1, wherein the electrode layer comprises copper, silver, aluminum or gold, and at least one of Cr and Ti.

13. The method for forming electrodes for a plasma display substrate according to claim 1, further comprising forming a layer comprising at least one of Cr and Ti, after the forming of the electrode layer.

14. The method for forming electrodes for a plasma display substrate according to claim 1, further comprising forming a thin film layer and removing a part of the thin film layer by applying a third laser beam to the thin film layer, before the forming of the mask layer or after the removing of the mask layer.

15. The method for forming electrodes for a plasma display substrate according to claim 1, further comprising forming black stripes on the transparent substrate.

16. The method for forming electrodes for a plasma display substrate according to claim 1, wherein the forming of the mask layer comprising one of applying a liquid-mask layer-forming material and laminating a film-shaped mask layer on the transparent substrate.

17. A method for forming electrodes and black stripes for a plasma display substrate, comprising:

forming a mask layer on a transparent substrate;

forming openings in the mask layer by applying a first laser beam;

forming an antireflection layer on the transparent substrate and on the mask layer, the antireflection layer comprising a first antireflection layer and a second antireflection layer and being configured to lower reflectance by interference of lights reflected from respective ones of the first antireflection layer and the second antireflection layer, the first antireflection layer being substantially transparent and having a refractive index at a wavelength of 550 nm in a range from 1.9 to 2.8, the second antireflection layer comprising at least one of Cr and Ti;

forming an electrode layer on an upper side of the antireflection layer; and removing the mask layer from the transparent substrate.

18. A plasma display substrate provided with electrodes, produced by a method for forming electrodes for a plasma display substrate, comprising:

forming a mask layer on a transparent substrate;

forming openings in the mask layer by applying a first laser beam;

forming an antireflection layer on the transparent substrate and on the mask layer, the antireflection layer comprising a first antireflection layer and a second antireflection layer and being configured to lower reflectance by interference of lights reflected from respective ones of the first antireflection layer and the second antireflection layer, the first antireflection layer being substantially transparent and having a refractive index at a wavelength of 550 nm in a range from 1.9 to 2.8, the second antireflection layer comprising at least one of Cr and Ti;

forming an electrode layer on an upper surface side of the antireflection layer; and removing the mask layer from the transparent substrate.

19. The plasma display substrate according to claim 18, wherein the plasma display substrate is a front substrate of plasma display, and the electrodes have a visible light reflectance of at most 50% from the substrate side.

20. A plasma display panel employing the plasma display substrate as defined in claim 18.

* * * * *